US006024806A

United States Patent [19]

Yoshino et al.

[11] Patent Number: 6,024,806

[45] **Date of Patent: *Feb. 15, 2000**

[54] A1-BASE ALLOY HAVING EXCELLENT HIGH-TEMPERATURE STRENGTH

[75] Inventors: Shoichi Yoshino, Osaka; Toshio Tani, Takatsuki; Kazuo Osada, Ryugasaki, all of Japan

[73] Assignee: Kubota Corporation, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/504,081

[22] Filed: Jul. 19, 1995

[51] Int. Cl.[7] ..... C22C 21/00

[52] U.S. Cl. ..... 148/437; 75/232; 75/252; 75/951; 420/550; 428/614

[58] Field of Search ..... 148/513, 514, 148/437; 420/550; 419/66, 67, 68, 69; 75/230, 232, 235, 236, 249, 252, 951; 428/614

[56] References Cited

U.S. PATENT DOCUMENTS

| | | | |
|---|---|---|---|
| 3,754,905 | 8/1973 | Knopp | 75/232 |
| 4,818,308 | 4/1989 | Odani et al. | 148/439 |
| 5,106,702 | 4/1992 | Walker et al. | 428/614 |
| 5,114,505 | 5/1992 | Mirchandani et al. | 148/437 |

*Primary Examiner*—George Wyszomierski
*Attorney, Agent, or Firm*—Armstrong, Westerman, Hattori, McLeland & Naughton

[57] ABSTRACT

An Al-base alloy prepared by hot-working a mixture of an Al alloy powder and dan Ni powder to join the powders and having a structure wherein Ni—Al intermetallic compounds are dispersed. The powder mixture can be hot-worked in the solid-phase temperature range, liquid phase temperature range or solid-liquid phase mixture temperature range of the Al alloy. A dispersion strengthening powder can be further admixed with the mixture of Al alloy powder and Ni powder.

18 Claims, 1 Drawing Sheet

A1-BASE ALLOY HAVING EXCELLENT HIGH-TEMPERATURE STRENGTH

FIELD OF THE INVENTION

The present invention relates to Al-base alloys obtained by the hot working of a powder mixture of Al alloy powder prepared by rapid solidification and Ni powder.

BACKGROUND OF THE INVENTION

Parts such as pistons, connecting rods and brake rotors, for use in the internal combustion engines of motor vehicles, motorcycles and the like must have a strength capable of withstanding intensive motion at high temperatures.

On the other hand, attempts have been made in recent years to reduce the weight of motor vehicles and the like from the viewpoint of savings of energy, and it is therefore desired to make the components thereof lightweight. Accordingly, aluminum alloys are placed into wide use for the above-mentioned parts for which a high strength is required at high temperatures of at least about 300° C.

Such an Al alloy having an excellent high-temperature strength is known and is prepared by solidifying a molten aluminum alloy at a high cooling rate of less than $10^{5}$° C./sec by gas atomization to obtain an Al alloy powder and shaping the powder by hot working (Unexamined Japanese Patent Publication No. 47448/1987).

Also available is a material which is prepared by subjecting a rapidly solidified Al alloy powder containing at least 13 wt. % of Si to hot plastic working to join the particles together.

The Al alloy powder is formed with an oxide film over the surface, so that when the powder is subjected to a usual hot-working process, the oxide film is present between the joined particles. Consequently, the joint between the particles is unsatisfactory which causes the problem that the alloy as shaped is deficient in high-temperature strength.

SUMMARY OF THE INVENTION

An object of the present invention is to provide an Al-base alloy which is prepared by hot-working a mixture of particulate materials under usual conditions to firmly join the particles of the materials together and which is given an excellent high-temperature strength.

More specifically, the object of the present invention is to provide an Al-base alloy having a compressive strength of at least 250 MPa at 300° C. and at least 200 MPa at 400° C.

The present invention provides an Al-base alloy prepared by hot-working a mixture of an Al alloy powder and a Ni powder to join the powders.

The present invention also provides an Al-base alloy prepared by hot-working a mixture of an Al alloy powder, a dispersion strengthening powder and a Ni powder to join the powders.

The Al alloy powder and Si—Al alloy powder to be used for preparing the Al-base alloys of the invention are those obtained by rapid solidification (for example, by atomization, melt spinning or melt extraction).

DETAILED DESCRIPTION OF THE INVENTION

Figure 1:
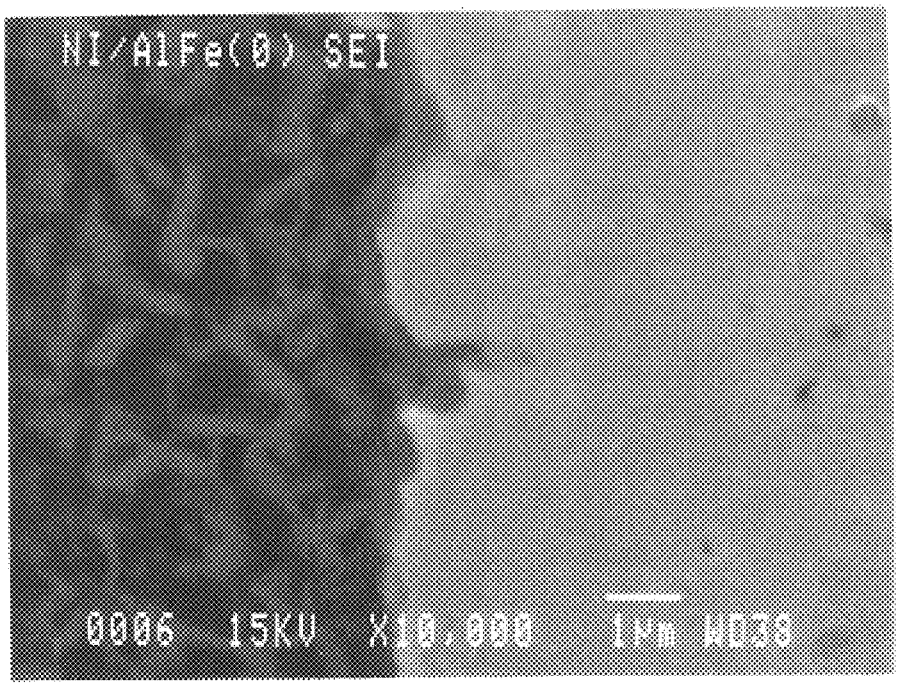
FIG. 1 is a photograph (X10000) showing the structure prepared from Sample No. 2 and obtained by EPMA.

As previously stated, the Al-base alloy of the present invention is prepared by hot-working a mixture of a Al alloy powder and an Ni powder to join the powders. During hot working, the Al alloy particles crushed to expose fresh surfaces, diffuse through the Ni powder and form at the boundaries between the Al alloy particles and the Ni particles an Al—Ni phase, which joins the powders. The presence of the Al—Ni phase makes the joined surfaces almost free of the influence of the oxide, forming satisfactory joints and giving an improved strength.

The Al-base alloy of the present invention has a structure wherein Ni—Al intermetallic compounds are dispersed.

The hot working operation for joining the powders can be carried out, for example, by hot extrusion, hot rolling, hot forging, hot pressing or hot isostatic pressing (HIP). The hot-working operation may be preceded by cold compression for preshaping.

The hot-working operation can be conducted in the solid-phase temperature range of the Al alloy or at a temperature not lower than the liquid-phase starting temperature thereof.

When the powder mixture is hot-worked in the solid-phase temperature range of Al alloy, the powders are merely joined together by the Al—Ni phase ($NiAl_3$ and the like) formed at the interface therebetween. Preferably, therefore, the alloy resulting from hot working is subjected to a diffusion heat treatment in the temperature range of 400 to 700° C. to promote the diffusion of Al through the Ni powder. The heat treatment forms a wide region wherein Al is diffused through the Ni powder. The Al-diffused region has a structure wherein a dislocation preventing substance (primary crystals of Si when Al—Si alloy powder is used, or $FeAl_3$ when Al—Fe alloy powder is used) in the Al alloy powder and Ni—Al intermetallic compounds (such as $NiAl_3$, $Ni_2Al_3$ and $FeNiAl_3$) are dispersed, and give the product a further improved high-temperature strength. The diffusion heat treatment is conducted at 400 to 700° C. because if the temperature is lower than 400° C., the diffusion takes place moderately, requires a longer period of time and leads to impaired productivity, and further because temperatures exceeding 700° C. result in excessive diffusion and an excessive liquid phase and are liable to cause collapsing. The treatment is conducted more preferably in the solid-phase range of 500 to 600° C.

In the case where the hot-working operation is conducted at a temperature not lower than the liquid-phase starting temperature of the Al alloy, a melt portion of the Al alloy reacts with Ni, and Ni—Al intermetallic compounds not lower than the eutectic temperature of the Al alloy are formed as dispersed in the melt portion to give an improved high-temperature strength. For example, when a mixture of Si-containing Al alloy powder and Ni powder is used, the melt solidified portion comprises Si and Ni—Al intermetallic compounds. Further when a mixture of Fe-containing Al alloy powder and Ni powder is used, the portion comprises Al and Ni—Al intermetallic compounds. The melting points of these Ni—Al intermetallic compounds are 855° C. for $NiAl_3$, 1135° C. for $Ni_2Al_3$, 1640° C. for NiAl and 1397° C. for $Ni_3Al$, and the eutectic point of the original Al alloy (570° C. for Al—Si alloy or 640° C. for Al—Fe alloy) disappears, so that the alloy obtained has high heat resistance. In the case where the hot-working operation is conducted in the liquid-phase temperature range of the Al alloy, it is also desirable to carry out the diffusion heat treatment after the operation.

It is most preferable to conduct the hot-working operation around the liquid-phase starting temperature of the Al alloy for the following reason. Around this temperature, the Al alloy is in the form of a mixture of solid phase and liquid phase, and the Ni—Al intermetallic compound forming reaction proceeds at the highest velocity when the powder mixture is subjected to pressure in a semi-molten state to form large quantities of intermetallic compounds.

It is desired that the mixture of Al alloy powder and Ni powder comprise 5 to 50 wt. % (preferably 15 to 50 wt. % from the viewpoint of flexural strength) of Al powder, and the balance Al powder because if less than 5 wt. % of Ni powder is present, the Ni powder will not act effectively to join the alloy powder thereto, and further because presence of more than 50 wt. % of Ni powder impairs the lightweightness of the resulting product.

It is desired that the Al alloy powder be up to about 590 μm in particle size, and that the Ni powder be up to about 10 μm in particle size.

The Al alloy powder to be used has such strength that the alloy obtained by hot working is at least 20 kgf/mm$^2$ at 300° C. in tensile strength.

The Al alloy powder to be used can be, for example, an alloy powder comprising 13 to 30 wt. % of Si and the balance substantially Al, or a powder of the alloy disclosed in the above-mentioned Unexamined Japanese Patent Publication No. 47448/1987 (comprising 5 to 17 wt. % of Fe, 1 to 7 wt. % of Ti, 1 to 7 wt. % of at least one element selected from the group consisting of Mo, Cr, W, Co and Ni, and the balance substantially Al).

Alternatively, the Al alloy powder can be an alloy powder comprising 15 to 25 wt. % of at least one element selected from the group consisting of Fe, Mn, Ni and Cr, and the balance substantially Al. Also usable is an alloy powder comprising 15 to 25 wt. % of at least one element selected from the group consisting of Fe, Mn, Ni and Cr, more than 0% to up to 3 wt. % of at least one element selected from the group consisting of Mo, V, Ti, Zr and Co, and the balance substantially Al.

When improved abrasion resistance is to be given to the Al-base alloy of the present invention, the powder mixture to be hot-worked further comprises a dispersion strengthening powder in addition to the Al alloy powder and Ni powder.

Preferably, the powder mixture comprises 5 to 50 wt. % (desirably, 15 to 50 wt. % from the viewpoint of flexural strength) of Ni powder, 3 to 25 wt. % of dispersion strengthening powder and the balance Al alloy powder.

Preferably, the dispersion strengthening powder is up to about 10 μm in particle size so as to obtain a homogeneous material.

Usable as dispersion strengthening powders are powders of lightweight hard ceramics such as SiC and $Al_2\mathbf{0}_3$.

Also usable as the dispersion strengthening power is an Si—Al alloy powder which comprises, in wt. %, 30 to 50% of Si, 5 to 20% of Ni, 3 to 15% of Cu, 1 to 10% of Fe, Ni+Cu+Fe being 20 to 35%, and the balance substantially Al.

The dispersion strengthening Si—Al alloy powder can be an alloy powder comprising, in wt. %, 30 to 50% of Si, 5 to 20% of Ni, 3 to 15% of Cu, 1 to 10% of Fe, Ni+Cu+Fe being 20 to 35%, 1 to 5% of at least one element selected from the group consisting of Zr, V, Ti, Ce, Nb, B and Co, and the balance substantially Al.

These alloys are Si- and Sl-base alloys, are therefore lightweight, have a high hardness (Hv 700–1000) and are satisfactory also in heat resistance and abrasion resistance. Furthermore, a Ni—Al aluminide formed permits the alloy to retain strength at high temperatures. A Cu—Al hard compound affords improved abrasion resistance and permits a very small amount of liquid phase to dissolve out stepwise in the wide temperature range of 530 to 750° C. Accordingly, the alloy forms a satisfactory joint with the Al alloy and exhibits lubricity at high temperatures.

In the case where the dispersion strengthening Si—Al alloy powder is used, it is desired to conduct the hot-working operation at a temperature of up to 650° C. because the rapidly solidified structure is likely to alter at temperatures exceeding 650° C.

The amounts of the respective components of the dispersion strengthening Si—Al alloy are limited as stated above for the following reasons.

Si: 30–50%

Si is used primarily for giving abrasion resistance and lightweightness. If the amount is less than 30%, insufficient abrasion resistance will result, whereas amounts exceeding 50% render the resulting material brittle.

Ni: 5–20%

Ni is incorporated in the alloy to form an Ni—Al heat-resistant aluminide and to contribute to an improvement in corrosion resistance. If the amount is less than 5%, the amount of aluminide formed will be insufficient, while amounts in excess of 20% make the alloy higher in melting point and difficult to melt.

Cu: 3–15%

Cu is present to contribute to improved corrosion resistance and to form a Cu—Al hard aluminide having a solid lubricating action. If the amount is less than 3%, an insufficient amount of aluminide will be formed, whereas if the amount is more than 15%, an excess of aluminide will be formed to produce a brittle material.

Fe: 1–10%

Like Ni, Fe acts to give improved heat resistance and higher high-temperature strength. If the amount is less than 1%, this effect is insufficient, whereas if the amount is more than 10%, large amounts of brittle Fe—Al intermetallic compounds are formed to embrittle the resulting material.

Ni+Cu+Fe: 20–35%

The combined content of Ni, Cu and Fe should be 20 to 35%. If the content is less than 20%, the combined amount of Ni—Al and Cu—Al aluminides is insufficient, failing to give excellent high-temperature strength and lubricity, whereas if the content is in excess of 35%, the resulting material increases in specific gravity and becomes less lightweight and difficult to melt.

When required, the dispersion strengthening Si—Al alloy may further have incorporated therein at least one element selected from the group consisting of Zr, V, Ti, Ce, Nb, B and Co in a combined amount of 1 to 5%, in addition to the foregoing elements. These components contribute to an improvement in heat resistance, whereas if the amount is less than 1%, this effect will not be expectable substantially, but amounts exceeding 5% result in an excessively high melting point to make the product difficult to melt.

The rapidly solidified Si—Al alloy is a solid solution supersaturated with the alloy elements. A major portion of the high Si content is in the form of fine particles of about 0.5 to about 3 μm which are formed on crystallization. The Si particles are surrounded by network-like complex intermetallic compounds such as Al—Ni—Cu—Fe, hence a strengthened structure.

The Al alloy powder serving as a starting material of the invention and the dispersion strengthening Si—Al alloy powder are those obtained by rapid solidification as previously described. Such powder is prepared, for example, by melting a material alloy at a temperature about 50 to about 200° C. higher than its melting point and rapidly cooling the melt at a rate of about $10^3$ to $10^{6°}$ C./sec by a suitable powdering method such as water or gas atomization or rotary water flow method. For example when the material is an Fe-containing Al alloy, rapid solidification thus effected provides an Al alloy powder wherein θ—$FeAl_3$ is finely dispersed.

The rotary water flow method is a method which uses a cooling water layer formed inside a cooling cylinder and flowing down its inner peripheral surface while whirling therealong, and in which a molten metal flow or melt drops formed by spraying the metal flow with an inert gas are supplied to the cooling water layer and thereby divided and rapidly solidified to obtain a metal powder. Using this method, particles having a relatively large mean size of about 200 μm can be readily prepared at a cooling rate of at least $10^{5°}$ C./sec.

EXAMPLE

Al alloy powders and dispersion strengthening powders comprising various components as listed in Table 1 were prepared by the rotary water flow method. The Al alloy powders were about 200 μm in mean particle size, and the dispersion strengthening powders were about 50 μm in mean particle size.

Next, an Ni powder about 5 μm in mean particle size was prepared.

These powders were uniformly mixed together according to the compositions shown in Table 1 to prepare powder mixture samples (No. 1 to No. 8) according to the invention. Samples No. 9 to No. 11 contained no Ni powder. Sample No. 9 is a conventional Si—Al alloy powder, Sample No. 10 is a powder of the alloy disclosed in the foregoing Unexamined Japanese Patent Publication No. 47448/1987, and Sample No. 11 is a comparative alloy powder having a great Ni content.

Each of the powder samples was hot-pressed at the shaping temperature shown in Table 1 under a pressure of 700 MPa to obtain a shaped body having an outside diameter of 64 mm. The shaped body was 99.9% in relative density.

Samples No. 3 to No. 6 and No. 8 were subjected to an Al diffusion heat treatment under the condition given in Table 1.

Test pieces were prepared from the shaped bodies thus obtained and tested for compressive strength at room temperature, 200° C., 300° C. or 400° C. For compressive strength testing, the test piece, which was in the form of a solid cylinder with a diameter of 5 mm and a length of 10 mm, was subjected to varying loads to determine the load when the test piece was broken. Table 1 also shows the measurements obtained.

TABLE 1

| | Powder mixture (wt. %) | | | | | Compressive strength (MPa) | | | |
|---|---|---|---|---|---|---|---|---|---|
| Sample No. | Al alloy powder | Ni powder | Dispersion strengthening powder | Shaping temp. (° C.) | Heat treatment (° C. × hr) | Room temp. | 200° C. | 300° C. | 400° C. |
| 1 | 70 (Si:27%,Al:bal.) | 30 | — | 570 | — | 1066 | 989 | 945 | 978 |
| 2 | 70 (Fe:18%,Al:bal.) | 30 | — | 570 | — | 659 | 476 | 402 | 238 |
| 3 | 70 (Fe:18%,Al:bal.) | 30 | — | 570 | 500 × 2 | 616 | 538 | 420 | 307 |
| 4 | 70 (Fe:18%,Al:bal.) | 30 | — | 570 | 570 × 2 | 597 | 520 | 471 | 381 |
| 5 | 70 (Fe:18%,Al:bal.) | 30 | — | 570 | 650 × 1 | 360 | 311 | 267 | 233 |
| 6 | 70 (Si:27%.Al:bal.) | 30 | — | 500 | 500 × 2 | 481 | 465 | 398 | 304 |
| 7 | 60 (Si:27%,Al:bal.) | 20 | 20 (Si:44%,Fe:4%, Cu:7%,Ni:12%, Al:bal.) | 570 | — | 1020 | 1009 | 921 | 905 |
| 8 | 60 (Si:27%,Al:bal.) | 20 | 20 (Si:44%,Fe:4%, Cu:7%,Ni:12%, Al:bal.) | 500 | 500 × 2 | 598 | 486 | 387 | 201 |
| 9 | 100 (Si:27%,Al:bal.) | — | — | 500 | — | 515 | 278 | 186 | 73 |
| 10 | 100 (Fe:18%,Ni:5%,Al:bal.) | — | — | 570 | — | 641 | 462 | 300 | 157 |
| 11 | 100 (Fe:18%,Ni:30%,Al:bal.) | — | — | 570 | — | 566 | 456 | 315 | 181 |

Note to Table 1:
The numerical values given in the parentheses for the Al alloy powder and the dispersion strengthening powder each show the proportion (wt. %) of component of the powder concerned.

The results given in Table 1 show that the shaped bodies of Samples No. 1 to No. 8, which are embodiments of the invention, have a compressive strength of at least250 MPa at 300° C. and at least 200 MPa at 400° C.

Especially, Samples No. 1 and No. 7 are outstanding in compressive strength. The exceedingly high compressive strength is considered attributable to formation of large amounts of intermetallic compounds because the mixture was subjected to pressure in a semi-melted state.

As compared with the above embodiments, Sample No. 9 is inferior in compressive strength at 300° C. and 400° C.

No. 10 and No. 11 are satisfactory in compressive strength at 300° C. but are deficient in compressive strength at 400° C. The reason appears to be as follows. Since Al failed to diffuse through Ni, Al and Ni particles were joined together under the influence of the oxide film on the surface of the Al alloy particles, hence they have an insufficient joint strength.

FIG. 1 shows the result of EPMA of the structure obtained from Sample No. 2. In FIG. 1, $Ni_2Al_3$ is identified at the boundary of the Ni powder. This compound is an Al—Ni phase formed at the boundary.

Figure 2:
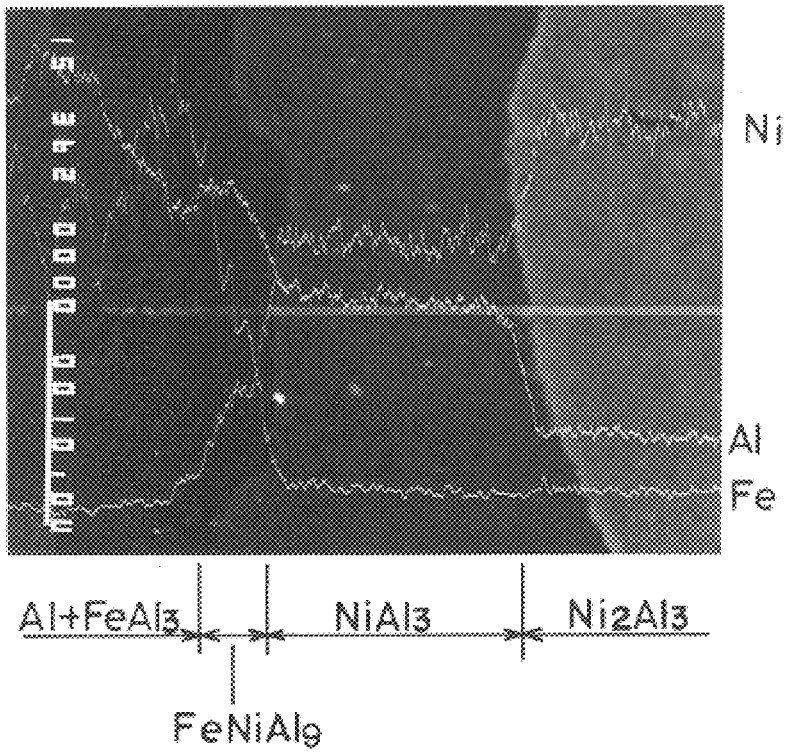
FIG. 2 is a photograph (X3000) showing the structure prepared from Sample No. 4 and obtained by EPMA.

FIG. 2 shows the result of EPMA of the structure of Sample No. 3. Sample No. 3 corresponds to No. 2 which was further subjected to diffusion heat treatment (at 500° C. for 2 hours). FIG. 2 reveals $NiAl_3$ and $FeNiAl_3$ in addition to $Ni_2Al_3$, indicating that the heat treatment promoted the diffusion of Al through the Ni powder.

What is claimed is:

1. An Al-base alloy prepared by hot-working a mixture of a powder of Al alloy containing therein at least about 70 weight % of Al and a powder of Ni, wherein the mixture comprises 95–50 weight % of the Al powder and 5–50 weight % of the Ni powder, the Al-base alloy having a compressive strength of at least 200 MPa at 400° C.

2. An Al-base alloy as defined in claim 1 wherein the mixture has been hot-worked in the solid-phase temperature range of the Al alloy.

3. An Al-base alloy as defined in claim 2 wherein the alloy obtained by hot working has been thereafter subjected to Al diffusion heat treatment in the temperature range of 400 to 700° C.

4. An Al-base alloy as defined in claim 1 wherein the mixture has been hot-worked at a temperature not lower than the liquid-phase starting temperature of the Al alloy.

5. An Al-base alloy as defined in claim 1 wherein the mixture has been hot-worked in the temperature range in which the Al alloy is present as a mixture of solid phase and liquid phase.

6. An Al-base alloy as defined in claim 1 which has a structure wherein Ni—Al intermetallic compounds are dispersed.

7. An Al-base alloy as defined in claim 1 wherein the Al-base alloy contains at least about 51 weight % of Al.

8. An alloy prepared by hot-working a mixture of powder of Al alloy containing therein at least about 70 weight % of Al, a powder of Ni and a powder of a dispersion strengthening alloy, wherein the mixture comprises 92–25 weight % of the Al alloy powder, 5–50 weight % of the Ni powder and 3 to 25 weight % of the dispersion strengthening alloy powder, the alloy having a compressive strength of at least 200 MPA at 400° C.

9. An alloy as defined in claim 8 wherein the mixture has been hot-worked in the solid-phase temperature range of the Al alloy.

10. An alloy as defined in claim 9 wherein the alloy obtained by hot working has been thereafter subjected to Al diffusion heat treatment in the temperature range of 400 to 700° C.

11. An alloy as defined in claim 8 wherein the mixture has been hot-worked at a temperature not lower than the liquid-phase starting temperature of the Al alloy.

12. An alloy as defined in claim 8 wherein the mixture has been hot-worked in the temperature range in which the Al alloy is present as a mixture of solid phase and liquid phase.

13. An alloy as defined in claim 8 which has a structure wherein Ni—Al intermetallic compounds have dispersed.

14. An alloy as defined in claim 8 wherein the dispersion strengthening powder is an Si—Al alloy powder prepared by rapid solidification, the Si—Al alloy powder comprising, in wt. %, 30 to 50% of Si, 5 to 20% of Ni, 3 to 15% of Cu, 1 to 10% of Fe, Ni+Cu+Fe being 20 to 35%, and the balance substantially Al.

15. An alloy as defined in claim 8 wherein the dispersion strengthening powder is an Si—Al alloy powder prepared by rapid solidification, the Si—Al alloy powder comprising, in wt. %, 30 to 50% of Si, 5 to 20% of Ni, 3 to 15% of Cu, 1 to 10% of Fe, Ni+Cu+Fe being 20 to 35%, 1 to 5% of at least one element selected from the group consisting of Zr, V, Ti, Ce, Nb, B and Co, and the balance substantially Al.

16. An alloy as defined in claim 8 wherein the dispersion strengthening powder is a powder of a lightweight hard ceramic.

17. An alloy as defined in claim 16 wherein the dispersion strengthening powder is a powder of SiC or $Al_2O_3$.

18. An alloy as defined in claim 8 wherein the alloy contains at least about 50 weight % of Al.

* * * * *